US005743394A

United States Patent [19]

Martin

[11] Patent Number: 5,743,394

[45] Date of Patent: Apr. 28, 1998

[54] MAGNETIC SOCKET HOLDER

[75] Inventor: John R. Martin, Naple, Fla.

[73] Assignee: Southern Mag-Clip, Inc., Sanibel, Fla.

[21] Appl. No.: 546,292

[22] Filed: Oct. 20, 1995

[51] Int. Cl.[6] ..... B65D 85/20

[52] U.S. Cl. ..... 206/378; 206/350; 206/493; 206/818; 211/70.6; 211/DIG. 1

[58] Field of Search ..... 206/378, 350, 206/377, 776, 818; 211/70.6; 248/206.5; 335/285

[56] References Cited

U.S. PATENT DOCUMENTS

| | | | |
|---|---|---|---|
| 1,712,473 | 5/1929 | McWethy | 206/378 |
| 3,405,377 | 10/1968 | Pierce . | |
| 3,726,393 | 4/1973 | Thompson | 206/378 |
| 4,337,860 | 7/1982 | Carrigan | 206/378 |
| 4,405,108 | 9/1983 | Muirhead . | |
| 4,621,738 | 11/1986 | DeLucchi | 206/378 |
| 4,688,672 | 8/1987 | Pemberton | 206/378 |
| 4,802,580 | 2/1989 | Andersen | 206/378 |
| 5,050,733 | 9/1991 | Brennan | 206/376 |
| 5,080,230 | 1/1992 | Winnard | 206/378 |
| 5,228,570 | 7/1993 | Robinson | 206/378 |
| 5,316,143 | 5/1994 | Horn | 206/378 |
| 5,343,181 | 8/1994 | Negus | 206/350 |
| 5,368,164 | 11/1994 | Bennett et al. | 206/376 |
| 5,456,359 | 10/1995 | Horn | 206/378 |
| 5,501,342 | 3/1996 | Geibel | 206/350 |

*Primary Examiner*—Paul T. Sewell
*Assistant Examiner*—Luan K. Bui
*Attorney, Agent, or Firm*—Burns, Doane, Swecker & Mathis, L.L.P.

[57] ABSTRACT

The magnetic socket holder according to the present invention includes a plurality magnets and associated posts which are adapted to receive sockets of varying sizes. The invention provides ready access to each socket and allows easy one handed removal and replacement of sockets. The magnetic socket holder includes a base having a series of recesses and magnets disposed in each of the recesses. Each of the magnets is provided with an associated post which is adapted to be receive within a socket. The posts and the magnets are preferably mounted to the base by a rivet. The magnets create a magnetic field which is sufficient to retain the sockets on the posts. While the combination of all the magnets provides a magnetic field which is sufficient to retain the socket holder and attached sockets on a support surface.

14 Claims, 1 Drawing Sheet

MAGNETIC SOCKET HOLDER

BACKGROUND OF THE INVENTION

1. Field of the Invention

The present invention relates to a magnetic socket holder for securely holding and storing loose sockets.

2. Description of the Related Art

Socket wrench holders are used for organizing and storing socket wrenches which are used in fields such as automobile repair, general maintenance, home repair, and general assembly. Known socket wrench holders include storage racks for sockets which generally consist of a metal strip to which spring clips are attached. The spring clips receive and hold each socket to the metal strip. However, removal of sockets from this type of socket storage rack is difficult because of the force applied to the sockets by the spring clips. Removal of sockets from this type of storage rack requires the use of two hands which is inconvenient when the user is in the middle of a task. Even with two hands the sockets are difficult to remove from this type of storage rack particularly if the user has oily hands.

Other known socket wrench holders utilize a tray having a series of troughs which are each configured to receive an individual socket of a particular size. These trays may be provided with a magnet in the base which helps to retain the sockets in the troughs. A socket wrench tray of this type is described in U.S. Pat. No. 5,343,181. These type of socket trays are inconvenient because the user must place each socket in a particular trough which is of the corresponding size and because the trays are large and bulky. The sockets may also fall out of the tray if the tray is knocked over or dropped.

SUMMARY OF THE INVENTION

The present invention provides a magnetic socket holder which addresses the problems of the known socket holders discussed above. The socket holder according to the present invention includes a plurality of magnets and associated posts which are adapted to receive sockets of varying sizes. The invention provides ready access to each socket and allows easy one handed removal and replacement of sockets.

According to one aspect of the invention, a magnetic socket holder includes a base having a plurality of recesses formed in a first side of the base and a plurality of magnets disposed in the recesses with a first side of the magnets substantially aligned with the first side of the base. A plurality of posts are each positioned at a center portion of each of the magnets and are adapted to receive sockets. Mounting means are provided for mounting each of the plurality of posts and each of the plurality of magnets to the base.

BRIEF DESCRIPTION OF THE DRAWING FIGURES

The invention will be described in greater detail with reference to the accompanying drawings in which like elements bear like reference numerals, and wherein.

DETAILED DESCRIPTION

Figure 1:
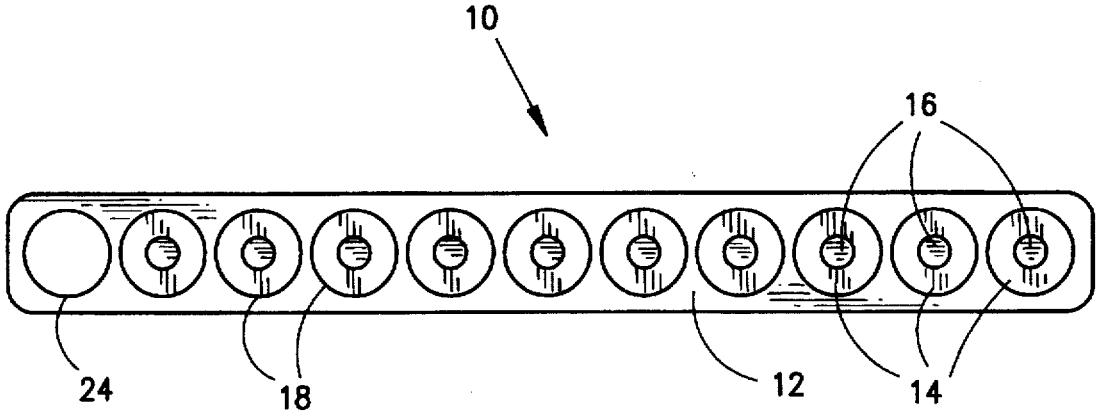
FIG. 1 is a top view of the magnetic socket holder according to the present invention.
Figure 2:
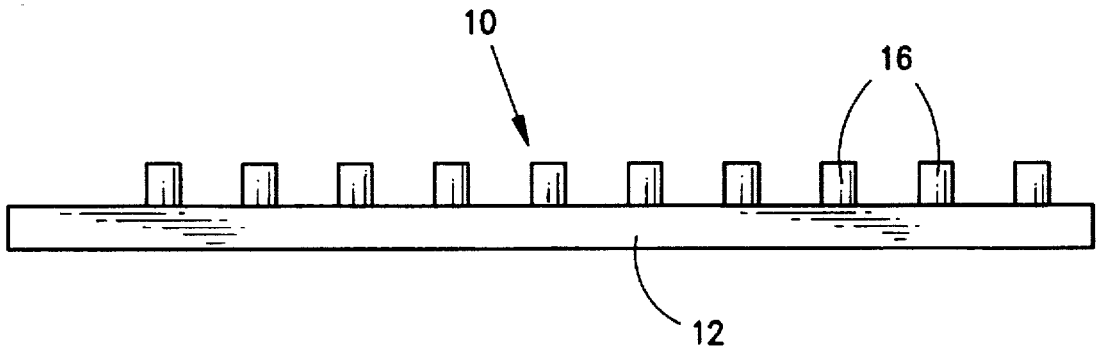
FIG. 2 is a side view of the magnetic socket holder of FIG. 1.

The magnetic socket holder 10 according to the present invention includes a base 12 having recesses into which a plurality of disk shaped magnets 14 are embedded. Posts 16 are provided on each of the magnets 14 for receiving sockets. The base 12 is an elongated member having a plurality of cylindrical recesses 18 formed in an upper surface thereof. The base 12 is preferably formed of a material which is somewhat flexible and is impervious to damage by oil, gasoline, grease, cleaning solvents and other materials commonly encountered by mechanics and maintenance personnel. The base 12 is preferably formed of plastic, such as, polyethylene, or other non-metallic materials which will not scratch or damage the surface on which they are placed.

The magnets 14 are illustrated in the drawing figures as disk shaped magnets having central bores for receiving the posts 16. However, magnets of other shapes such as rectangular may be used without departing from the spirit of the invention. The posts 16 are of a diameter which accommodates the interior of a known size socket. The posts 16 are preferably cylindrical posts which easily accommodate square drive sockets without the necessity of alignment between the socket and the post. However, square posts may also be used. The posts 16 are approximately the height of a corresponding socket drive member of a socket wrench handle. The posts 16 are preferably formed of a magnetic material such as cold rolled steel.

The magnets 14 are of such a strength so as to securely hold the sockets in place on the posts 16 even when the holder is in a vertical or inverted position. In addition, the plurality of magnets 14 together provide a magnetic field which is sufficient to hold the entire strip with a full set of sockets attached, firmly against a vertical or even an inverted magnetic surface. The magnets 14 are placed at a sufficient distance apart in the base 12 to allow for different diameter sockets to be placed adjacent to one another on the holder. In particular, the magnets 14 and posts 16 are spaced so that the largest diameter sockets of a set may be positioned adjacent one another without interfering with each other. Accordingly, sockets of any size may be placed on any of the posts 16 of the holder 10.

Figure 3:
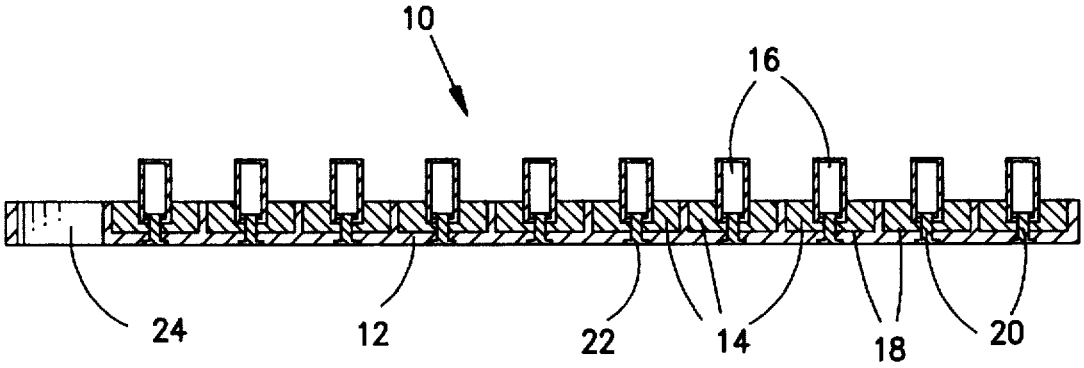
FIG. 3 is a cross-sectional side view through the center of the magnetic socket holder of FIG. 1.

The posts 16 and magnets 14 may be held in the recesses 18 in the base 12 by a rivet 20 such as a pop rivet. The head 22 of the rivet 20 is preferably recessed into the base 12, as shown in FIG. 3, so that the head does not protrude from the back surface of the base.

The magnets 14 are preferably assembled in the base 12 such that adjacent magnets are arranged with alternating polarities. For example, if the first magnet has a north pole positioned on the top of the holder, the second magnet will have a south pole positioned on the top of the holder. By positioning the magnets 14 with alternating polarities, a strong magnetic field is created through the posts 16 and hence through the sockets which aids in holding the sockets against the magnets and the base. The alternating magnets 14 also create a strong magnetic field through the rivets 20 which is sufficient to hold the holder 10 against the side of a support surface such as a tool box, hoist, automobile hood, fender, or door. The plastic material of the base 12 is preferably soft enough, and the rivets 20 are preferably sufficiently recessed, so that the holder will not scratch or abrade the surface on which it is placed.

According to the present invention, different holders can be provided for each type or size of socket set to be accommodated. Holders according to the present invention may be adapted to hold socket sets with ¼", ⅜", and ½" square drive sockets by providing correspondingly sized posts 16 and magnets 14. For example, in a holder for a ¼"

square drive socket set, a magnet having an outer diameter of approximately 0.75", an inner diameter of 0.25", and a thickness of approximately 0.187"would be appropriate. While in a holder for a ⅜" or ½" square drive socket set, a magnet having an outer diameter of approximately 1.25", an inner diameter of approximately 0.375", and a thickness of 0.187".

For larger socket set sizes, such as those with ½" square drive sockets and above, the plastic of the base 12 can be reinforced along the outer edges to prevent excessive bending of the base. For example, a ½" socket holder may be reinforced with ¼" reinforcing rails attached, cast into, or machined along the outer edges of the base.

Additional mechanical holding of the sockets to the base 12 can be achieved by extending the posts 16 by adding a smaller diameter portion on the top of the posts which extends further into the interior of the sockets.

The base 12 is also preferably provide with a finger hole 24 which may be used for holding the socket holder and for hanging the holder on an nail or peg.

The magnetic socket holder according to the present invention preferably holds up to ten sockets and is provided in three sizes for receiving sockets from the three common sized socket sets. The present invention provides an advantage over known socket holders in that the sockets are securely held while they can still be removed and replaced on the socket holder easily with one hand. In addition, the socket holder according to the present invention will not magnetize the sockets.

While the invention has been described in detail with reference to a preferred embodiment thereof, it will be apparent to one skilled in the art that various changes can be made, and equivalents employed without departing from the spirit and scope of the invention.

What is claimed is:

1. A magnetic socket holder comprising:

a base having a plurality of recesses formed in a first side of the base;

a plurality of magnets, each of said plurality of magnets disposed in one of the plurality of recesses with a first side of each of the plurality of magnets substantially aligned with the first side of the base;

a plurality of posts for receiving sockets, each of the plurality of posts positioned at a center portion of one of the plurality of magnets; and mounting means for mounting each of the plurality of posts and each of the plurality of magnets to the base.

2. The magnetic socket holder according to claim 1, wherein the plurality of recesses are arranged generally linearly.

3. The magnetic socket holder according to claim 2, wherein the magnets disposed in adjacent recesses are arranged with opposite polarities.

4. The magnetic socket holder according to claim 1, wherein the base is formed of a flexible material.

5. The magnetic socket holder according to claim 1, wherein the base is formed of plastic.

6. The magnetic socket holder according to claim 1, wherein the plurality of posts are formed steel.

7. The magnetic socket holder according to claim 1, wherein the mounting means comprises rivets.

8. The magnetic socket holder according to claim 7, wherein the rivets are pop rivets which extend from the posts to a second side of the base.

9. The magnetic socket holder according to claim 8, wherein the rivets include heads which are recessed into the second side of the base.

10. The magnetic socket holder according to claim 1, wherein the plurality of recesses are each of the same size and shape.

11. The magnetic socket holder according to claim 1, wherein the base is provided with a hole at one end thereof for holding or hanging the holder.

12. The magnetic socket holder according to claim 1, wherein the plurality of magnets are disk shaped.

13. The magnetic socket holder according to claim 1, wherein the plurality of magnets individually create a magnetic field sufficient to retain a socket and the plurality of magnets together create a magnetic field which is sufficient to hold the socket holder and a plurality of sockets in a vertical position on a support surface.

14. The magnetic socket holder according to claim 1, wherein the plurality of posts are cylindrical posts for being received in square drive sockets.

* * * * *